US009905943B2

(12) United States Patent
Herrmann et al.

(10) Patent No.: US 9,905,943 B2
(45) Date of Patent: Feb. 27, 2018

(54) CLAMPING CAGE FOR AN EDGE CONNECTOR

(71) Applicant: Weidmueller Interface GmbH & Co. KG, Detmold (DE)

(72) Inventors: Michael Herrmann, Detmold (DE); Constantin Classen, Detmold (DE); Karlo Stjepanovic, Blelefeld (DE)

(73) Assignee: Weidmüller Interface GmbH & Co. KG (DE)

( * ) Notice: Subject to any disclaimer, the term of this patent is extended or adjusted under 35 U.S.C. 154(b) by 0 days.

(21) Appl. No.: 14/915,881

(22) PCT Filed: Sep. 11, 2014

(86) PCT No.: PCT/EP2014/069375
§ 371 (c)(1),
(2) Date: Mar. 1, 2016

(87) PCT Pub. No.: WO2015/036472
PCT Pub. Date: Mar. 19, 2015

(65) Prior Publication Data

US 2016/0211591 A1 Jul. 21, 2016

(30) Foreign Application Priority Data

Sep. 16, 2013 (DE) ..... 10 2013 110 157

(51) Int. Cl.
*H01R 4/48* (2006.01)
*H01R 43/16* (2006.01)
*H01R 9/26* (2006.01)

(52) U.S. Cl.
CPC ..... *H01R 4/4818* (2013.01); *H01R 4/4836* (2013.01); *H01R 4/4845* (2013.01);
(Continued)

(58) Field of Classification Search
CPC ..... H10R 4/4818; H01R 43/16
(Continued)

(56) References Cited

U.S. PATENT DOCUMENTS 7,255,592 B1 8/2007 Tseng
7,607,956 B2 * 10/2009 Lang ..... H01R 4/4827 439/728

FOREIGN PATENT DOCUMENTS

DE 299 11 123 U1 9/2000
DE 203 03 537 U1 6/2003
(Continued)

*Primary Examiner* — Abdullah Riyami
*Assistant Examiner* — Justin Kratt
(74) *Attorney, Agent, or Firm* — Laubscher, Spendlove & Laubscher, P.C.

(57) ABSTRACT

A connector module for connecting the bare end of an insulated electrical conductor with an electrical device, including a hollow generally-rectangular terminal cage body formed from a bent conductive first metal sheet to form at least one vertical generally rectangular side wall and a pair of end walls, one of the cage walls having a horizontal lower surface defining a first cage sealing surface, and a vertical interior wall surface defining a second cage sealing surface; a horizontal bus bar formed from a conductive second metal sheet and having a relatively broad horizontal top surface defining a horizontal first bus bar sealing surface, and a relatively narrow side surface defining a vertical second bus bar sealing surface; and a securing seam for securing one of the bus bar first and second sealing surfaces with the corresponding one of the cage first and second sealing surfaces.

24 Claims, 5 Drawing Sheets

(52) U.S. Cl.
CPC ..... *H01R 43/16* (2013.01); *H01R 4/48* (2013.01); *H01R 9/26* (2013.01)

(58) Field of Classification Search
USPC ..... 439/835, 436, 437, 438, 439, 440, 441
See application file for complete search history.

(56) References Cited

FOREIGN PATENT DOCUMENTS

| | | | | |
|---|---|---|---|---|
| DE | 102 53 858 | A1 | 6/2004 | |
| DE | 10253858 | A1 * | 6/2004 | ..... H01R 4/4818 |
| DE | 10 2004 062 850 | B3 | 6/2006 | |
| DE | 10 2006 004 271 | B4 | 10/2007 | |
| DE | 10 2007 059 640 | A1 | 6/2009 | |
| DE | 10 2010 010 262 | A1 | 9/2011 | |
| EP | 1 403 968 | A2 | 3/2004 | |
| WO | 2011/009837 | A1 | 1/2011 | |

* cited by examiner

Fig. 1a
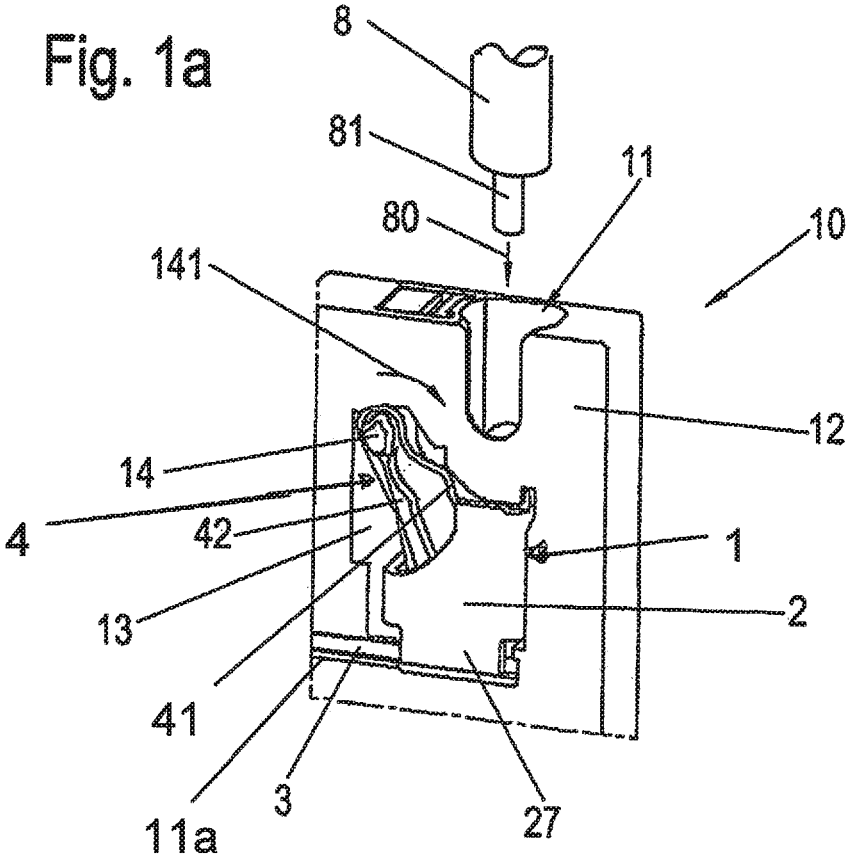
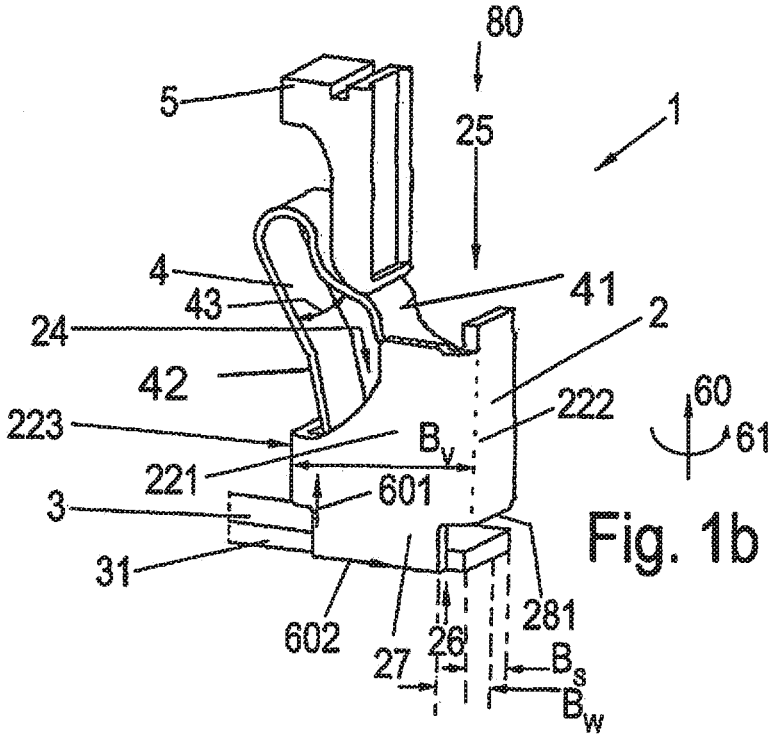
Fig. 1b

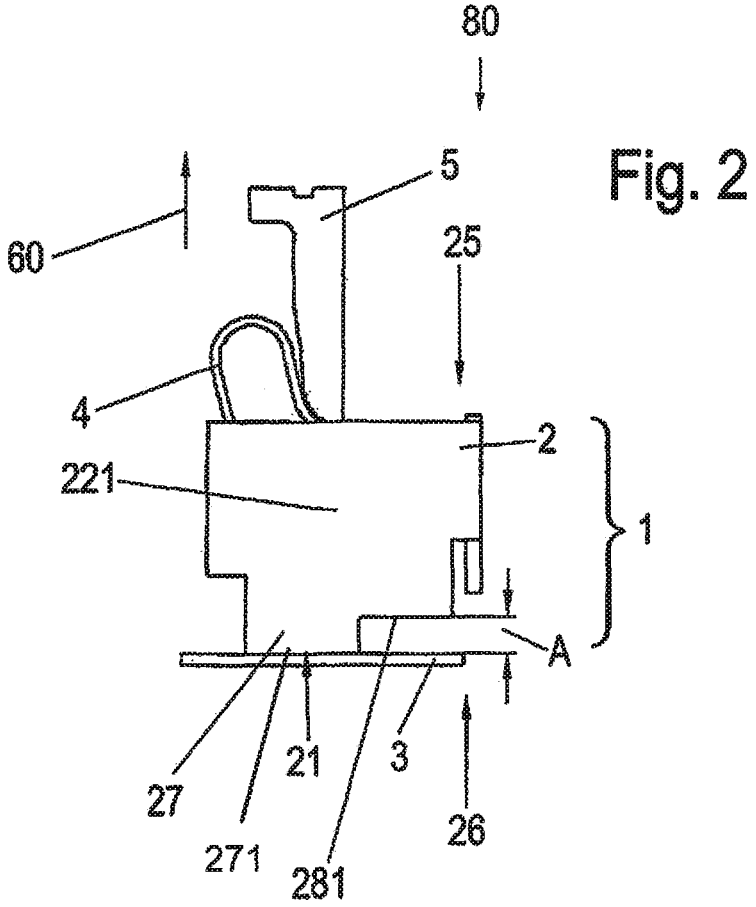
Fig. 2
Fig. 3
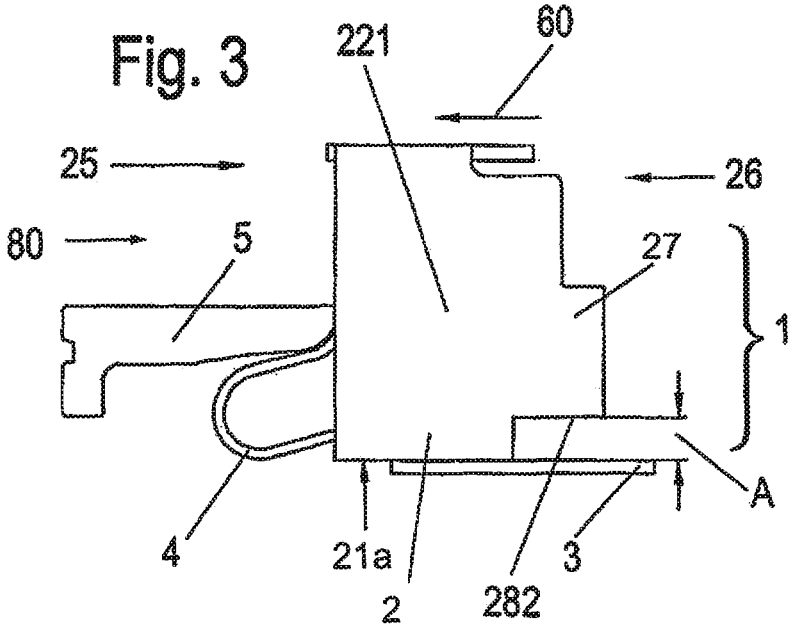

Fig. 4a
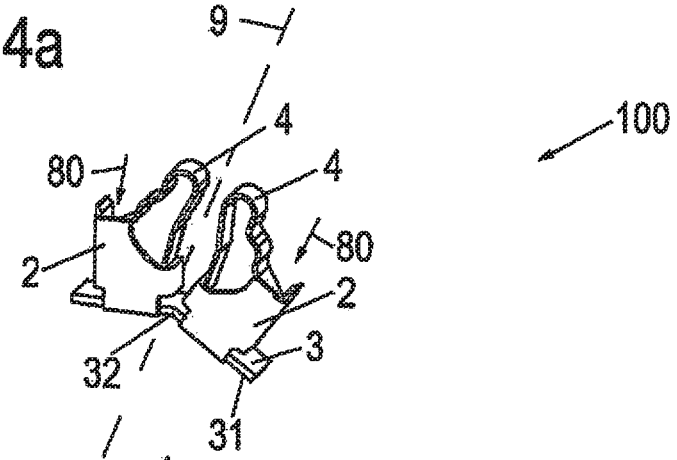
Fig. 4d
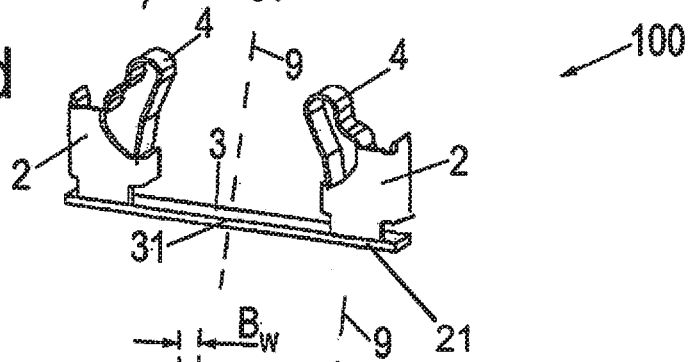
Fig. 4b
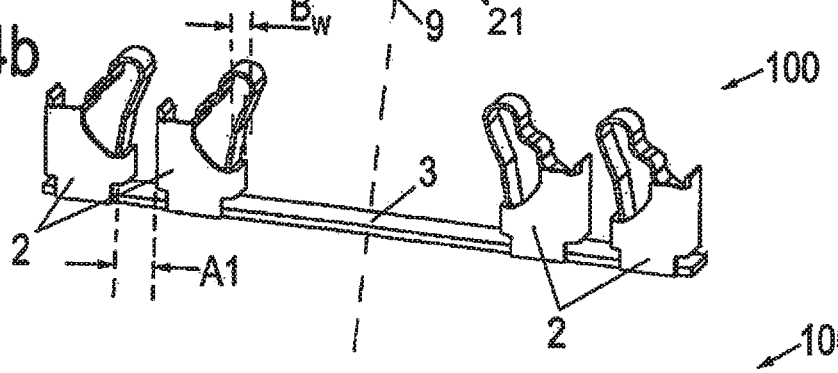
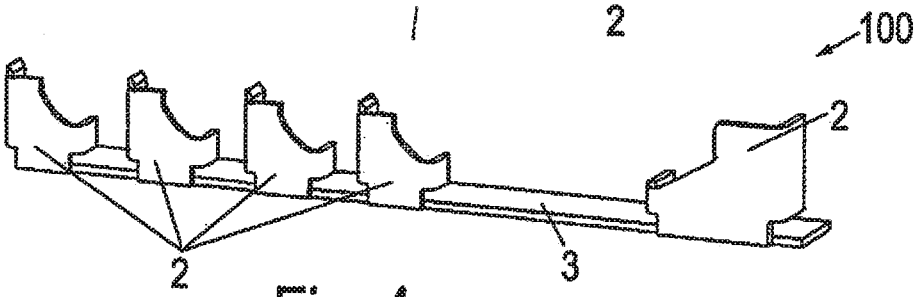
Fig. 4c

Fig. 5a
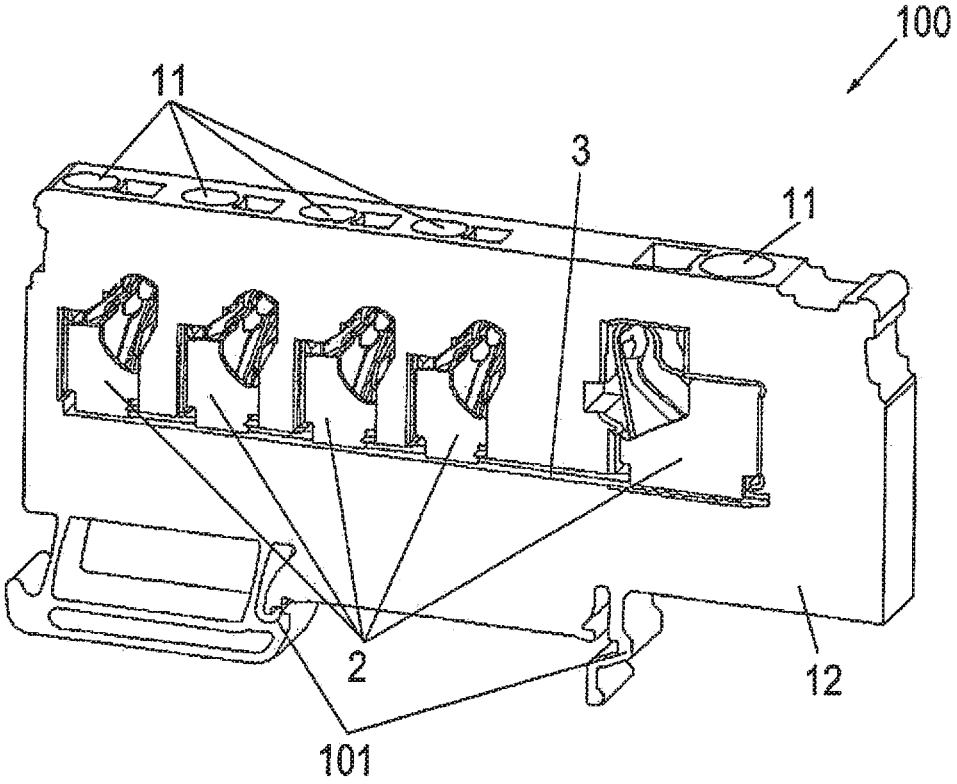
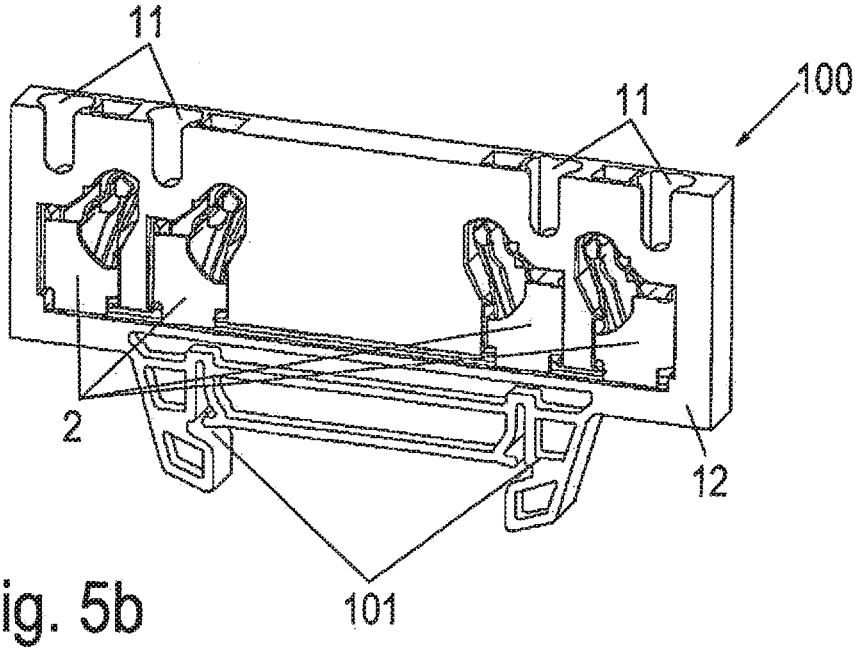
Fig. 5b

CLAMPING CAGE FOR AN EDGE CONNECTOR

REFERENCE TO RELATED APPLICATIONS

This application is a national stage application under 35 C.F.R. § 371 of the PCT International Application No. PCT/EP2014/069375 filed Sep. 11, 2014, which claims priority of the German application No. DE 10 2013 110 157.7 filed Sep. 16, 2013.

BACKGROUND OF THE INVENTION

Field of the Invention

A connector module includes a hollow generally-rectangular terminal cage body bent from a conductive first metal sheet to form at least one vertical generally rectangular side wall and a pair of end walls, one of the cage walls having a horizontal lower surface defining a first cage sealing surface, and a vertical interior wall surface defining a second cage sealing surface; a horizontal bus bar formed from a conductive second metal sheet and having a relatively broad horizontal top surface defining a horizontal first bus bar sealing surface, and a relatively narrow side surface defining a vertical second bus bar sealing surface; and a securing arrangement for securing one of the bus bar first and second sealing surfaces with the corresponding one of the cage first and second sealing surfaces.

Description of Related Art

For the connection of an electrical conductor to an electrical assembly, connection devices are commonly used in which the insulated end of the electrical conductor is pushed or pulled by means of a spring or a spring-mounted pressure piece against a bus bar. Here, the bus bar is connected or can be connected to the electrical assembly.

Such connection devices are usually produced in a modular design and then they have a terminal cage in which the clamping site is located where the spring or the pressure piece pushes or pulls the conductor end to the bus bar.

Numerous designs are known for the production of such connection modules. The designs differ, for example, in the materials used for the terminal cage, the spring and the bus bar.

Commonly, the terminal cage and the spring are produced so as to form a single part from a material with satisfactory spring properties, for example, from a spring steel, and the bus bar is produced separately from a satisfactorily conductive material, for example, from copper. These construction elements can also be produced separately, wherein, for the terminal cage, optionally a very inexpensive, preferably thin-walled material can be used. Such connection devices with separately produced bus bar are featured, for example, in the German publication No. DE 20 2011 000 714 U1.

It is also known to produce the bus bar and the terminal cage, and optionally also the spring, so as to form a single part. However, in these connection modules, the terminal cage is relatively complicated and for that reason requires a lot of material with a large amount of waste. In addition, satisfactorily conductive material such as copper, for example, is expensive. Moreover, single-part production of a bus bar and a terminal cage requires a large spacing between several connection modules arranged one after the other.

Therefore, the problem of the invention is to provide a connection module in which the terminal cage is indeed made from a satisfactorily conductive material, in particular from a copper-containing metal or from copper, but can nevertheless be produced cost-effectively, and also to provide a direct plug-in terminal with a connection module, a series connection device with several connection modules, and a method for producing the connection module.

SUMMARY OF THE INVENTION

Accordingly, a primary object of the present invention is to provide a connector module for connecting the bare end of an insulated electrical conductor with an electrical device, including a hollow generally-rectangular terminal cage body bent from a conductive first metal sheet to form at least one vertical generally rectangular side wall and a pair of end walls, one of the cage walls having a horizontal lower surface defining a first cage sealing surface, and a vertical interior wall surface defining a second cage sealing surface; a horizontal bus bar formed from a conductive second metal sheet and having a relatively broad horizontal top surface defining a horizontal first bus bar sealing surface, and a relatively narrow side surface defining a vertical second bus bar sealing surface; and a securing arrangement for securing one of the bus bar first and second sealing surfaces with the corresponding one of the cage first and second sealing surfaces.

Another object of the invention is to provide with such a connector module a resilient generally inverted V-shaped spring contact mounted between the cage end walls, said spring contact having a stationary first leg adapted to react with the inner surface of a first end wall, and a second leg biased away from said first leg to displace the bare end of a conductor toward electrical engagement with the inner surface of the other cage end wall. The cage body is mounted within a chamber contained in a housing formed of insulating material.

According to the present invention, a connection module for an electrical connection device is provided for connecting an electrical conductor to an electrical assembly, which comprises a terminal cage as well as a bus bar. The terminal cage is provided in order to provide a clamping site for the electrical conductor. The terminal cage and the bus bar are produced independently of one another, in each case forming a single part, from a satisfactorily electrically conductive flat strip. As a satisfactorily electrically conductive flat strip material it is preferable to use a copper alloy for the flat strips. The flat strips, from which the terminal cage and the bus bar are produced, in each case present two broad sides facing one another and narrow sides that connect said broad sides. The terminal cage and the bus bar are provided for carrying an electrical current.

It is preferable that the terminal cage and/or the bus bar are produced as punched parts or as punched and folded parts. The narrow sides of the flat strip of the bus bar in this way form narrow sides of the bus bar, and the narrow sides of the flat strip of the terminal cage in this way form narrow sides of the terminal cage.

Here, both a production of the terminal cage and of the bus bar from the same flat strip, and also a production of the terminal cage and of the bus bar from different flat strips, particularly flat strips having different thicknesses, are preferable. Here, the thickness of the bus bar and of the terminal cage is dimensioned so that both the bus bar and also the terminal cage have sufficient mechanical stability as well as sufficient current carrying capacity.

The terminal cage has at least three walls arranged at a right angle with respect to one another, which extend parallel or substantially parallel to a conductor entry direction. Here, the formulation "substantially parallel" covers a terminal cage in which at least one of the walls is arranged at an acute angle relative to the conductor entry direction, in particular at an angle of 0°-60°. However, it is particularly preferable that all the walls of the terminal cage extend parallel to the conductor entry direction. Here, the walls are preferably arranged at a right angle with respect to one another.

The connection module is characterized in that either the terminal cage is fastened permanently on a narrow side of the bus bar or the bus bar is fastened permanently (in particularly, firmly bonded) on a narrow side of the terminal cage.

In comparison to a single-part production of the terminal cage with bus bar, in this design of the connection module, there is hardly any waste, so that the proportion of waste and thus the material consumption in the production can be clearly reduced. Although the production of this connection module requires an additional method step, in which the terminal cage and the bus bar are fastened permanently to one another, the production of the connection module can nevertheless be considerably more cost-effective due to the saving of expensive flat strip material.

Since the narrow sides of the flat strip for the terminal cage are the narrow sides of the terminal cage, and since the narrow sides of the flat strip for the bus bar are the narrow sides of the bus bar, the narrow sides of the terminal cage have the thickness of the flat strip used for the terminal cage, and the narrow sides of the bus bar have the thickness of the narrow sides of the flat strip used for the bus bar.

In a preferred embodiment, the terminal cage is designed so that it is U-shaped. Here it is preferable that two of the walls are narrow walls which are connected by the third wall, referred to below as connecting wall. One of the narrow walls is preferably provided for supporting a spring. Moreover, between the second narrow wall and the spring, a clamping site for the electrical conductor is preferably provided. In another preferred embodiment, the terminal cage is designed so that it is square in cross section. In this embodiment, it is preferably designed circumferentially closed or also preferably circumferentially open.

In the embodiment in which the terminal cage is designed so that it is U-shaped, it encloses the clamping site to a large extent. In the embodiment in which the terminal cage is designed so that it is square in cross section, it encloses the clamping site nearly completely or even completely.

It is preferable that the terminal cage and the bus bar are fastened to one another at a linear connection seam. They are particularly preferably fastened firmly bonded, most particularly preferably by welding, particularly by resistance welding or by laser welding.

The terminal cage preferably has a longitudinal extent. It is preferable that it encloses at least partially an inner space in a circumferential direction relative to the longitudinal extent. Preferably, in the interior space, the clamping site for clamping the electrical conductor is arranged on the terminal cage or on the bus bar.

In a particularly material-saving embodiment, the terminal cage is moreover designed to be open on two end faces facing one another that are arranged transversely to the longitudinal extent. It is preferable that the bus bar is arranged on one of the end faces and, in particular, parallel to said end face. The interior space of the terminal cage in this embodiment as well remains accessible, at least from the facing end face.

In order to be able to fasten the bus bar particularly simply to the terminal cage, it is preferable that the terminal cage has a first wall which is extended relative to at least one additional wall or a portion of the first wall of the terminal cage, so that this wall has an extension. The extension is preferably designed in the shape of a rectangular tongue. Preferably, the extension is extended relative to at least one upper edge, lower edge or side edge of a wall of the terminal cage. It is preferable that the bus bar is fastened to the extension on the terminal cage. As a result, the bus bar is at a distance from the upper edge, the lower edge or the side edge, and it can be placed highly flexibly in the connection module in accordance with a specific application.

The problem is moreover solved by a direct plug-in terminal which comprises such a connection module. The direct plug-in terminal is preferably a spring-loaded terminal which has a spring. The spring is preferably arranged at least partially in the interior space of the terminal cage and provided in order to press an electrical conductor against the bus bar or to pull said electrical conductor onto the bus bar. It is preferable that the direct plug-in terminal comprises a housing made of an insulation material. The housing made of an insulation material preferably encloses the entire circumference of the terminal cage. In addition, it is preferable that, in the insulation material housing, a conductor entry opening is provided, through which an electrical conductor can be introduced into the terminal cage, in particular into the clamping site.

The problem is moreover solved by a series connection device with at least two such connection modules. The series connection device is characterized in that the connection modules have a common bus bar, and a distance between adjacent terminal cages of the connection module is smaller than a width of one of the terminal cages, in particular of a narrow side of the terminal cage. In comparison to a single-part production of a series connection device with several connection modules arranged adjacently along the bus bar, the terminal cages of the series connection device according to the invention can be produced independently of their width, in particular of the width of their narrow walls. Therefore, they can be arranged closer to one another. Preferably, a distance between adjacent terminal cages of the series connection device according to the invention is less than 0.7 times the width of a narrow wall of one of the terminal cages, particularly preferably less than 0.5 times the width of the narrow wall.

The problem is solved moreover by a method for producing such a connection module, in which a terminal cage and a bus bar are produced independently of one another in each case as a single part made from a satisfactorily electrically conductive flat strip, and in which, thereafter, either the terminal cage is fastened firmly bonded on a narrow side of the bus bar formed by a narrow side of the flat strip of the bus bar, or the bus bar is fastened firmly bonded on narrow side of the terminal cage formed by a narrow side of the flat strip of the terminal cage. The fastening occurs preferably in a firmly bonded manner by welding, preferably by resistance welding or laser welding.

In spite of the several method steps needed in this production method, namely the mutually independent production of a terminal cage and a bus bar and their subsequent connection to one another, the production of the connection module using expensive materials can be clearly more cost-effective due to the considerable material savings in comparison to single-part production of the connection module.

BRIEF DESCRIPTION OF THE DRAWINGS

Other objects and advantages of the invention will become apparent from a study of the following specification, when viewed in the light of the accompanying drawing, in which:

FIG. 1*a* is an explodeed perspective view of a plug in terminal block including a first connector module embodiment, and FIG. 1*b* is a perspective view of a second connector module embodiment;

FIGS. 2 and 3 are side views of embodiments of the invention wherein the conductor entry directions are vertical and horizontal, respectively, relative to a horizontally arranged bus bar;

FIGS. 4*a*-4*d* are perspective views illustrating embodiments having a plurality of connector modules mounted on a common bus bar;

FIG. 5*a* is a perspective view illustrating the connector module arrangement of FIG. 4*b* mounted in a terminal block housing; and FIG. 5*b* is a perspective view of the connector module arrangement of FIG. 4*c* mounted in a terminal block housing.

DETAILED DESCRIPTION OF THE INVENTION

Figure 1C:
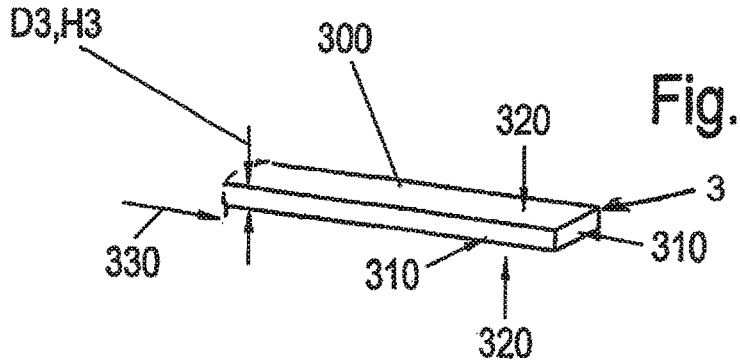
FIGS. 1*c* and 1*d* are perspective views of the conductive sheets from which the bus bar and the cage body are formed, respectively.

Referring first to FIGS. 1*a* and 1*b*, a terminal block connector 10 includes a housing 12 formed of electrically insulating material, which housing contains a chamber 13 in which is mounted a connector module 1, and a first conductor inlet opening 11 for introducing the bare end 81 of an insulated conductor into the chamber along a longitudinal entry axis 80. As best shown in FIG. 1*b*, the connector module 1 includes a cage body 2 that is formed by bending a planar sheet 200 (FIG. 1*d*) of conductive metal, thereby to define at least one side wall 221, and a pair of orthogonally arranged end walls 222, 223. One end of a horizontal bus bar 3 is introduced into housing chamber 13 via a second inlet opening 11*a*. As shown in FIG. 1*c*, the bus bar 3 is formed from a conductive metal strip 300 having a rectangular cross section to define a pair of relatively wide horizontal top and bottom wall surfaces 320, and a pair of relatively narrow vertical side wall surfaces 310.

Also mounted in the chamber 13 on a fixed support pin 14 is an inverted V-shaped spring 4 having a first leg 42 in engagement with one end wall 223 of the cage body 2 of the connector module 1, and a second leg 41 biased toward the other end wall 222 of the cage body. A manually operable release member 5 is vertically slideably mounted in the housing 12 for displacing the spring leg 41 toward the spring leg 42, thereby to permit insertion and removal of the conductor bare end into the chamber 13. Consequently, when the release member 5 is in the released condition of FIG. 1*b*, the spring leg 41 biases the conductor bare end 81 toward electrical engagement with the end wall 222 of cage body 2.

As will be explained in greater detail below, in the embodiment of FIGS. 1*b* and 1*e*, the bus bar 3 vertical side wall 310 (FIG. 1*c*) is permanently welded to the inside vertical surface of the cage tongue portion 27 that extends downwardly from the lower edge 281 (FIGS. 1*b* and 1*d*) from the cage side wall 221. The cage tongue portion 27 terminates at its lower end in a horizontal lower edge 21. The bus bar is welded to the tongue portion flush with this lower horizontal edge 21 so that a spacing distance A (FIG. 1*e*) is provided between the upper surface 320 of the bus bar and the lower edges 281 of the end walls.

The terminal cage body 2 and the bus bar 3 are produced independently of one another and are then fastened permanently to one another. The terminal cage body extends in a longitudinal direction 60 which is here opposite the conductor entry direction 80. The bus bar 3 in this embodiment is arranged on the terminal cage body 2 in such a way that it extends transversely to the conductor entry direction 80.

For pivoting the first spring arm 41 in the pivoting direction 141 (FIG. 1*a*), the pressure member 5 can be actuated manually, in particular with a tool such as the tip of a screwdriver (not shown). Here, the first spring arm 41 is actuated by actuating the pressure piece 5 in a conductor entry direction 80 so that a clamping site (not shown), which is arranged in the interior space 24 of the terminal cage 2, opens. In this state, an electrical conductor 8 can be introduced into the clamping site. By releasing the pressure piece 5, the first spring arm 41 is pivoted back due to the restoring force of the spring 4 against the pivoting direction 141, and the electrical conductor 8 introduced into the clamping site is clamped between the spring 4 and the terminal cage 2. Therefore, the terminal cage body 2 is provided here for providing the clamping site.

The insulated electrical conductor 8 is represented diagrammatically in FIG. 1*a*. It has a bare conductor end 81 by means of which it can be introduced into the clamping site. In FIG. 1*b*, the spring 4 and the pressure piece 5 are arranged in the position relative to the connection module 1 in which they are arranged in the connector terminal block 10.

FIG. 1*c* shows the flat strip 300 from which the bus bar 3 is produced. The flat strip 300 extends in an unrolling direction 330, wherein the narrow vertical sides 310 extend transversely to and along the unrolling direction 330. The flat strip 300 has a constant thickness D3 which corresponds to the height H3 of the narrow sides 310.

In order to produce a bus bar 3 for the connection module 1 of FIG. 1*b* from this flat strip 300, the flat strip 300 is merely cut to length. Therefore, the bus bar 3 is preferably produced as a punched part. Therefore, the narrow sides 310 of the flat strip 300 are the narrow sides 31 of the bus bar 3. Moreover, the broad sides 320 of the flat strip 300 are also the broad sides 32 of the bus bar 3.

Figure 1F:
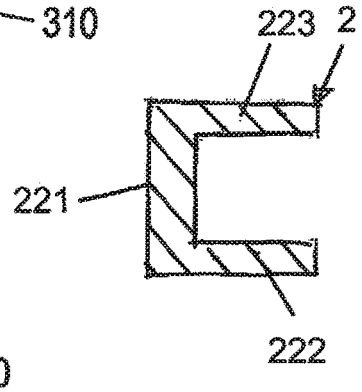
FIGS. 1*f* and 1*g* are cross sectional views of three-sided and four-sided embodiments of the invention, respectively.
Figure 1D:
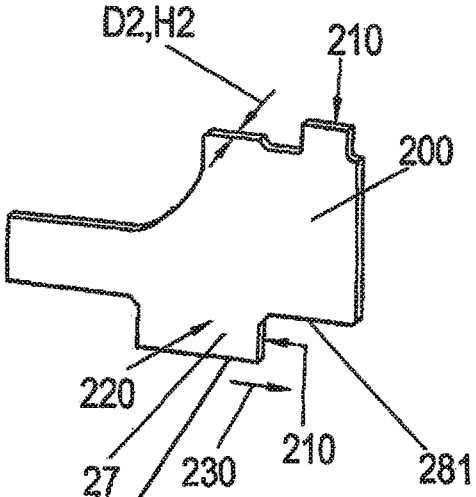

Similarly, the terminal cage 2 is produced from a flat strip 200 unrolled in the unrolling direction 230. Here, the shape of the broad sides 220 is adapted, for example, by punching or sawing. Subsequently, the flat strip 200 is folded to form the terminal cage body 2. Therefore, the terminal cage body 2 is produced as a punched and folded part. The narrow sides 210 of the flat strip 200 which has been adapted and folded in this way are the narrow sides 210 of the terminal cage 2. They have a height H2 which corresponds to the thickness D2 of the flat strip 200. FIG. 1*d* shows the unrolled view of the terminal cage body 2.

Figure 1G:
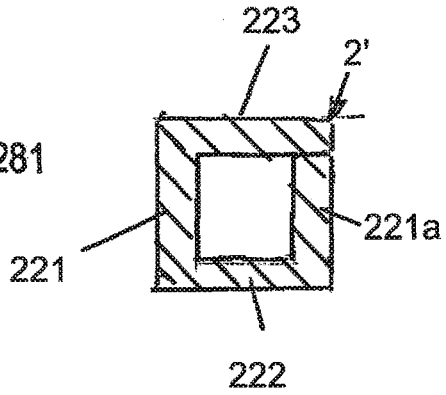
Figure 1E:
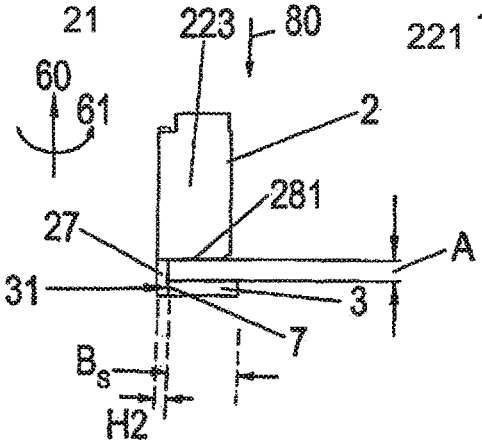
FIG. 1*e* is an end view of a cage body formed by bending the sheet of FIG. 1*d;*

The terminal cage body 2 of FIGS. 1*b* and 1*e* is designed so that it has a square cross section. Therefore, it has either four walls 221, 221*a*, 222, 223 (FIG. 1*g*), or three walls 221, 222, 223 (FIG. 1*f*). The walls 221-223 are arranged at an approximately right angle relative to one another. They in each case have an extension component 602 in the longitudinal direction 60 as well as an extension component 601 transversely to the longitudinal direction 60 of the terminal cage 2. Here as well, the longitudinal direction 60 extends opposite the conductor entry direction 80. The walls 221-223 are therefore provided parallel to the conductor entry direction 80.

In order to be able to produce the smallest possible direct plug-in terminal 10 with the connection module 1, the terminal cage 2 has two walls 222, 223 facing one another which have a width $B_W$, which here corresponds to a width $B_S$ of the bus bar 3 plus the height H2 of the narrow sides 21 of the terminal cage 2. The end walls 222, 223 facing one another are also referred to as narrow walls.

The spring 4 is supported on a first of the two narrow walls 223. The clamping site is arranged between the spring 4 and a second of the two narrow walls 222.

The narrow walls 222, 223 are connected to one another by a connecting wall 221. The connecting wall 221 has a larger width $B_V$, as determined by the spring and a clamping angle 41 of the spring 4, than the narrow walls 222, 223.

Here, a first wall 221 of the terminal cage body 2 is extended relative to its other walls 222, 223, so that this wall 221 has an extension 27 designed as a rectangular tongue. The terms extension 27 and tongue are used synonymously below. The tongue 27 therefore extends over a lower edge 281 of the terminal cage 2, viewed in the conductor entry direction 80.

In the represented embodiment example of FIGS. 1*b* and 1*e*, the bus bar 3 is fastened on the extension 27 on the terminal cage 2. In particular, it is fastened with one of its narrow sides 31 on the extension 27 on the terminal cage 2. Here, it is provided flush with an edge 271 of the extension 27. As a result, it is at a distance from the lower edge 281. The distance A is represented in FIG. 1*e*.

The fastening occurs preferably in a firmly bonded manner, preferably by welding. As a result, a connection seam 7, along which the bus bar 3 is arranged on the terminal cage body 2, has a linear design. By laser welding or resistance welding, a very precise and accurate production of the connection seam 7 is possible.

FIGS. 2 and 3 show two additional embodiments of connector modules 1 according to the invention. In both embodiments, in contrast to the embodiment of FIGS. 1*b* and 1*e*, the bus bar 3 is arranged on a narrow side 21 of the terminal cage body 2.

Here, the bus bar 3 of FIG. 2 extends transversely to the longitudinal direction 60 of the terminal cage body 2, that is to say parallel to the end faces 25, 26 of the terminal cage 2, and, in FIG. 3, in the longitudinal direction 60, that is to say transversely to the end faces 25, 26 of the terminal cage body 2. As a result, the terminal cage 2 of FIG. 2 is accessible from outside from one of the end faces 25, and the terminal cage body 2 of FIG. 3 is accessible from both end faces 25, 26.

In both embodiments, the first side wall 221 is extended. In the embodiment of FIG. 2, the first side wall 221 is extended so that, when viewed in the conductor entry direction 80, it projects relative to a lower edge 281 of a wall 222, 223 of the terminal cage 2. The bus bar 3 is here provided flush with an edge 271 of the extension 27. Therefore, it is separated in this embodiment from the lower edge 281 by the distance A.

On the other hand, in the embodiment of FIG. 3, the first wall 221 is extended so that, viewed in the conductor entry direction 80, it projects over a side edge 282 of the terminal cage 2. Therefore, in this embodiment, the bus bar 3 is at a distance A from the side edge 282.

The connection modules 1 produced in this manner have the advantage, compared to the connection modules known to date (not shown), that, in their production, a considerable material savings of approximately 15%-25% is possible.

FIGS. 4*a* to 4*d* show, in each case, a series connection device 100 with at least two such connection modules 1 each without a housing 12. The connection modules 1 in each case have a common bus bar 3 as well as at least two or more terminal cage bodies 2. In the embodiments of FIGS. 4*a*-4*c*, the terminal cage body 2 is welded in each case on the narrow side 31 of the bus bar 3. In the embodiment of FIG. 4*d*, on the other hand, it is welded with its narrow side 21 on the bus bar 3. In both cases, the terminal cage 2 is connected at its tongue 27 to the bus bar 3.

In the embodiment of FIG. 4*a*, two connection modules 1 are provided. The terminal cage bodies 2 of the two connection modules 1 are arranged on the common bus bar 3. Between the terminal cages 2, the bus bar 3 has a bend 32, so that the conductor entry directions 80 of an electrical conductor into the terminal cages 2 are arranged with respect to one another at an angle (not marked) determined by the bend 32.

Moreover, the two terminal cages 2 here are in a mirror symmetrical arrangement with respect to an axis of symmetry 9. As a result, they are oriented opposite one another. Their conductor entry openings 11 are arranged, therefore, on the side facing away from their adjacent terminal cage 2.

In the series connection device 100 of FIG. 4*b*, in each case two connection modules 1 oriented in the same direction are arranged grouped with respect to one another at the smallest possible distance apart A1. The series connection device 100 has two such groups of connection modules 1, wherein the connection modules 1 of the two groups are in a mirror symmetrical arrangement with respect to the axis of symmetry 9. The terminal cages 2 of the two groups are, therefore, oriented opposite one another.

In comparison to a single-part production of a series connection device (not shown), in which a distance between two adjacent connection modules (not shown) is determined by a width of the adjacent terminal cages (not shown), in particular of their narrow walls, the series connection arrangement 100 according to the invention allows a very tight placement of the terminal cages 2 on the bus bar 3, because the production of the bus bar 3 and the production of the terminal cages 2 occur independently of one another. The distance A1 between adjacent 2 terminal cages can therefore be selected to be very small. It can be selected to be smaller than the sum of the widths B of the narrow walls 223, 222 of the adjacent terminal cages 2.

In the series connection device 100 of FIG. 4*c*, four connection modules 1 oriented in the same direction are arranged grouped with respect to one another at the smallest possible distance apart A1. The distance A1 is smaller than the sum of the widths B of the narrow walls 2222, 223 of the adjacent terminal cages 2. In addition, the series connection device 100 has a connection module 1 oriented in the opposite direction, which is farther apart from the four grouped connection modules 1.

The series connection device 100 of FIG. 4*d* has two connection modules 1 in a mirror symmetrical arrangement with respect to the axis of symmetry 9, which are arranged a large distance apart from one another.

FIG. 5*a* shows the series connection device 100 of FIG. 4*c*, and in FIG. 5*b*, the series connection devices 100 of FIG. 4*b*, each with housing 12. Both series connection devices 100 have snap-in mounting feet 101, by means of which they can be arranged on a hat-shaped mounting rail (not shown), as is known in the art. As a result, several such series connection devices 100 can be arranged in a row next to one another on the same mounting rail.

While in accordance with the provisions of the Patent Statutes the preferred forms and embodiments of the invention have been illustrated and described, it will be apparent to those skilled in the art that changes may be made without deviating from the invention described above.

What is claimed is:

1. A connector module for connecting a bare end of an insulated electrical conductor with an electrical device, comprising:

(a) a hollow generally-rectangular terminal cage body formed from a bent conductive first metal sheet, said cage body having a longitudinal conductor entry axis and including:

(1) at least one vertical generally rectangular side wall; and (2) a pair of parallel spaced generally-rectangular longitudinally-extending end walls connected with said side wall, one of said cage walls having:

(a) a horizontal lower surface defining a bottom surface of said cage body;

(b) a vertical interior wall surface; and (b) a horizontal bus bar formed from a conductive second metal sheet having a rectangular cross section, including:

(1) a relatively broad horizontal top surface defining a horizontal bus bar surface, and (2) a relatively narrow side surface, said bus bar being connected with said terminal cage body by securing said horizontal bus bar surface with said cage body bottom surface.

2. A connector module as defined in claim 1, wherein said cage end walls are orthogonally arranged relative to said cage side wall.

3. A connector module as defined in claim 2, wherein said cage body includes four walls and has a generally square transverse cross-sectional configuration.

4. A connector module as defined in claim 2, wherein said cage body includes three walls and has a generally U-shaped transverse cross-sectional configuration.

5. A connector module as defined in claim 1, wherein said bus bar is connected with said terminal cage body by a linear welded seam.

6. A connector module as defined in claim 1, wherein said conductor entry axis is vertical.

7. A connector module as defined in claim 6, wherein said at least one side wall of said cage body includes a downwardly extending tongue portion having a horizontal bottom edge defining said cage body bottom surface.

8. A connector module as defined in claim 1, wherein said conductor entry axis is horizontal.

9. A connector module for connecting a bare end of an insulated electrical conductor with an electrical device, comprising:

(a) a hollow generally-rectangular terminal cage body formed from a bent conductive metal sheet, including:

(1) at least one vertical relatively-wide generally rectangular side wall; and (2) a pair of parallel spaced vertical relatively-narrow generally-rectangular end walls orthogonally connected with said side wall, said side wall having a horizontal lower edge, and a coplanar tongue portion extending downwardly from said side wall lower edge, said tongue portion having:

(a) a horizontal tongue portion lower edge defining a horizontal first cage surface; and (b) a vertical interior wall surface defining a vertical second cage surface; and (b) a horizontal bus bar formed from a conductive metal sheet and having a rectangular cross section including:

(1) a relatively broad horizontal top surface defining a first bus bar surface, and (2) a relatively narrow vertical side surface defining a second bus bar surface, said bus bar being connected with said terminal edge body by securing one of said first and second bus bar surfaces with the corresponding one of said first and second cage surfaces.

10. A connector module as defined in claim 9, and further comprising:

(d) a resilient generally inverted V-shaped spring contact mounted between said cage end walls, said spring contact having a stationary first leg adapted to react with an inner surface of a first cage end wall, and a second leg biased away from said first leg to displace the conductor bare end toward electrical engagement with an inner surface of the other can end wall.

11. A connector module as defined in claim 10, and further comprising a spring release member operable to displace said second spring leg toward said first spring leg, thereby to permit insertion and removal of the conductor relative to said cage body.

12. A connector module as defined in claim 10, and further comprising:

(e) a housing formed of insulating material and containing:

(1) a chamber in which said cage body is mounted; and (2) an inlet opening for introducing the conductor bare end into said housing chamber.

13. A connector module as defined in claim 10, wherein a plurality of said modules are secured in spaced relation on said bus bar.

14. A connector module as defined in claim 13, wherein the spacing distance between some of said modules is less than the width of one of said cage body end walls.

15. The method for forming a connector module, comprising the steps of:

(a) bending a first conductive metal sheet to define a cage body having a longitudinal entry axis and including:

(1) at least one vertical generally rectangular side wall; and (2) a pair of parallel spaced generally-rectangular longitudinally-extending end walls connected with said side wall, one of said cage walls having:

(a) a horizontal lower surface defining a horizontal first cage surface at a bottom of said cage body; and (b) a vertical interior wall surface defining a vertical second cage surface;

(b) forming a horizontal bus bar from a second conductive metal sheet having a rectangular cross section, including:

(1) a relatively broad horizontal top surface defining a horizontal first bus bar surface, and (2) a relatively narrow side surface defining a vertical second bus bar surface; and (c) connecting said bus bar with said cage body by securing one of said bus bar first and second surfaces with the corresponding one of said cage first and second surfaces, respectively.

16. The method for forming a connector module as defined in claim 15, and further comprising the step of:

(d) mounting a resilient generally inverted V-shaped spring contact between said cage end walls, said spring contact having a stationary first leg adapted to react with an inner surface of a first end wall, and a second leg biased away from said first leg to displace the conductor bare end toward electrical engagement with an inner surface of the other cage end wall.

17. The method for forming a connector module as defined in claim 16, and further comprising the step of:

(e) mounting the cage body in a chamber contained in a housing formed of insulating material.

18. The method for forming a connector module as defined in claim 15, wherein said connecting step comprises welding one of said bus bar first and second surfaces with the corresponding one of said cage first and second surfaces, respectively, along a linear seam.

19. A connector module for connecting a bare end of an insulated electrical conductor with an electrical device, comprising:

(a) a hollow generally-rectangular terminal cage body formed from a bent conductive first metal sheet, said cage body having a longitudinal conductor entry axis and including:

(1) at least one vertical generally rectangular side wall; and (2) a pair of parallel spaced generally-rectangular longitudinally-extending end walls connected with said side wall, one of said cage walls having:

(a) a horizontal lower surface defining a bottom surface of said cage body;

(b) a vertical interior wall surface defining a vertical cage surface; and (b) a horizontal bus bar formed from a conductive second metal sheet having a rectangular cross section, including:

(1) a relatively broad horizontal top surface, and (2) a relatively narrow side surface defining a vertical bus bar surface, said bus bar being connected with said terminal cage body by securing said vertical bus bar surface with said vertical cage surface.

20. A connector module as defined in claim 19, wherein said cage end walls are orthogonally arranged relative to said cage side wall.

21. A connector module as defined in claim 20, wherein said cage body includes four walls and has a generally square transverse cross-sectional configuration.

22. A connector module as defined in claim 20, wherein said cage body includes three walls and has a generally U-shaped transverse cross-sectional configuration.

23. A connector module as defined in claim 19, wherein said bus bar is connected with said terminal cage body by a linear welded seam.

24. A connector module as defined in claim 19, wherein said conductor entry axis is vertical.

* * * * *